United States Patent [19]

Kleinert et al.

[11] Patent Number: 4,909,550

[45] Date of Patent: Mar. 20, 1990

[54] CORE SLING LIFTING FIXTURE

[75] Inventors: Stephen S. Kleinert, Ephrata; Jeffrey M. Klibert, Lancaster, both of Pa.

[73] Assignee: Lift-All Company, Inc., Manheim, Pa.

[21] Appl. No.: 290,751

[22] Filed: Dec. 27, 1988

[51] Int. Cl.[4] ..... B65H 49/00; B66C 1/16

[52] U.S. Cl. ..... 294/67.1; 294/158

[58] Field of Search ..... 294/1.1, 32, 67.1, 67.3, 294/67.4, 74, 82.1, 82.11, 86.4, 89, 93, 94, 137, 149, 151–153, 156, 158; 24/115 R, 115 K; 206/453; 242/85, 85.1, 129, 129.5; 414/684, 910, 911

[56] References Cited

U.S. PATENT DOCUMENTS

| | | | |
|---|---|---|---|
| 268,130 | 11/1882 | Roberts | 294/67.1 |
| 1,510,564 | 10/1924 | Stockfleth | 294/67.1 |
| 2,702,641 | 2/1955 | Arthur | 294/67.1 X |
| 3,021,010 | 2/1962 | McMasters | 294/67.1 |
| 3,289,666 | 12/1966 | Prather | 294/67.1 |
| 3,542,413 | 11/1970 | Hardison | 294/67.1 |
| 3,626,508 | 12/1971 | Sharrow | 294/89 |
| 3,768,852 | 10/1973 | Back et al. | 294/1.1 X |
| 3,778,002 | 12/1973 | Alleweireldt | 294/67.1 |
| 4,133,435 | 1/1979 | Hosbein | 294/67.1 X |
| 4,345,788 | 8/1982 | Newton | 294/67.1 |
| 4,796,939 | 1/1989 | Symonds et al. | 294/67.1 |

FOREIGN PATENT DOCUMENTS

| | | | |
|---|---|---|---|
| 1139944 | 11/1962 | Fed. Rep. of Germany | 294/158 |
| 204688 | 12/1983 | German Democratic Rep. | 294/67.1 |

*Primary Examiner*—Johnny D. Cherry
*Attorney, Agent, or Firm*—Martin Fruitman

[57] ABSTRACT

A lifting fixture for objects with a hollow core such as paper rolls. A relatively thick base plate with two parallel slots accepts a channel shaped fixture which protrudes up through the slots and forms a saddle for a web lifting strap. The channel also includes end tabs extending parallel to the base plate surface and bearing upon it to relieve the corner stress in the base plate slots. An upright cylinder attached to the assembly aids in protecting the core of the item lifted.

5 Claims, 2 Drawing Sheets

CORE SLING LIFTING FIXTURE

SUMMARY OF THE INVENTION

This invention deals generally with hoist line implements and more specifically with a handler for a load with a hollow core.

The most desirable method of handling and lifting a load with a hollow core, a load such as a large paper roll, frequently is by lifting from the center core. Numerous prior art patents show various implements to accomplish this task, and most use some sort of rigid or semi-rigid lifting attachment to a part which inserts into one end of the core. The rigid attachment then protrudes through the core and is lifted from the other end. Furthermore, virtually all prior art systems construct the core insert so that it fits tightly into the roll core, purportedly to maintain balance during lifting.

In truth, both the requirements of a rigid or semi-rigid lifting member and a tight fitting core part are not necessary, and merely lead to added complexity and cost. The rigid or self supporting requirement for the lifting member is unnecessary because any lifting means, even a limp rope, can easily be hooked from within a core by conventional crane attachments. Moreover, the lifting members used for heavy paper rolls, which are the most common cored items lifted, must be so strong that they are never completely limp. A typical web lifting sling, for instance, has enough bulk and stiffness that it will never collapse completely, and will always be easily retrievable from within the core.

As for the cup-like part which is inserted tightly into the core to attach to the lifting member, the possibility of attaining a truly balanced load is virtually impossible. Therefore, a somewhat loose support member for the core does not in any way make the load less likely to be balanced.

The requirements of a rigid lifting member and a tightly fitting core part actually just add cost and inconvenience to a lifting fixture. Tight tolerances of a core part clearly add to cost as does a specially constructed lifting member, but the rigid lifting member also makes storage of the lifting fixture difficult when it is not in use. The long extension of the lifting member requires a large storage space and makes entanglement among several units very likely.

The present invention reduces both the cost and storage problems associated with core lifting fixtures by using a standard web sling for the lifting member and using a unique, simple, low cost support member to hold the core.

The core support member is actually constructed of only two basic parts with one additional optional part for centering the core if that is required. The first part is a base plate which is used to lift the core by being under one end of the core. This base plate need not be of any particular shape, but in the preferred embodiment it is essentially rectangular because, with that configuration, better utilization of material can be attained.

The base plate has two parallel slots cut into it, and the second part, a channel shaped part, is sized to have its legs fit through the two slots and extend through the base plate. The web of the channel spans the space in the base plate between the slots and essentially rests against it. However, the web of the channel extends beyond its legs so that the channel part essentially has ears extending from both ends. These ears, like the web of the channel, rest against the under surface of the base plate.

The channel part therefore forms a saddle which straddles the bar of the base plate which separates the slots. The slots, however, have generous clearance on the outside of the saddle, so that the webbing of a conventional web lifting sling can be positioned over the saddle.

It is this web sling which will extend through the core of the load, and by which the load will be lifted. During the lifting, the base plate supports the core of the load while the saddle protects the webbing from chafing and damage from the edges of the slots. The ears extending from the saddle and parallel to the plane of the base plate distribute the load from the small bar between the base plate slots to the entire base plate and thereby relieve the severe stress which would otherwise occur at the corners of the slots.

An optional additional part for the lifting fixture is a core lateral support cylinder. This cylinder is added to the lifting fixture on the side of the base plate from which the saddle legs extend. Moreover, it can be attached by forcing its inside diameter into a friction fit with the extended saddle legs. By this means the center cylinder can be added with little cost and it helps protect the interior of the load core from damage from the edges of the saddle legs.

The result is a simple, low cost fixture which can be used with standard web lifting slings and which offers convenience of both use and storage.

DETAILED DESCRIPTION OF THE INVENTION

Figure 1:
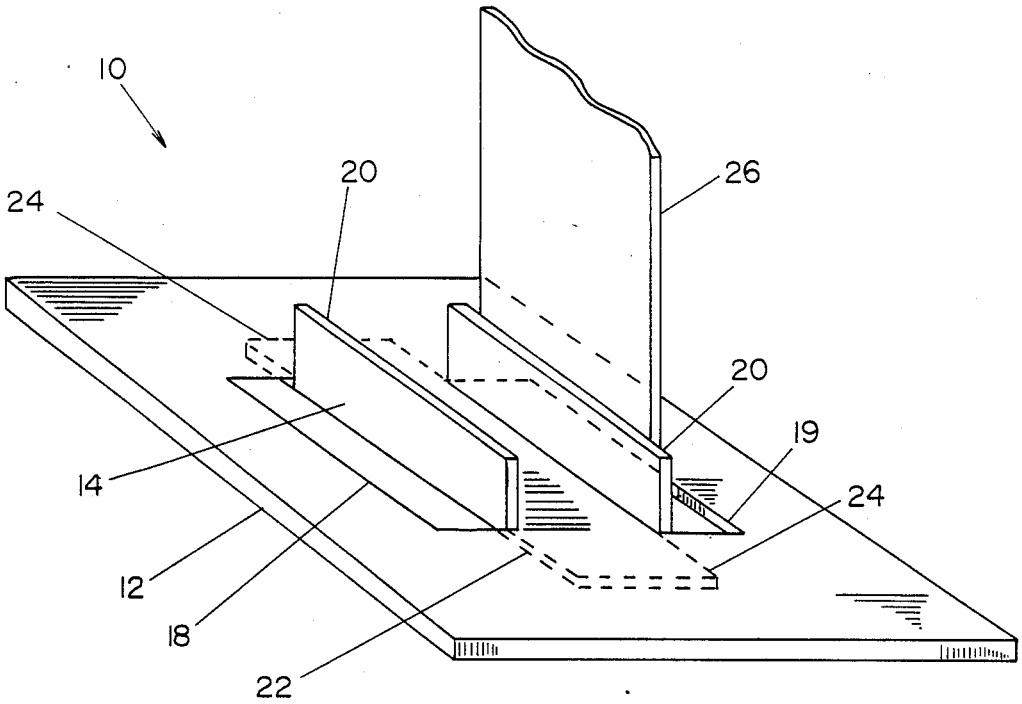
FIG. 1 is a perspective view of the preferred embodiment of the invention with only one side of the webbing loop which passes through it shown, in order to better view the lifting fixture.

FIG. 1 shows a perspective view of the preferred embodiment of the invention in which core lifting fixture 10 is assembled from only base plate 12 and saddle fitting 14.

Base plate 12 is a simple plate constructed of a material of sufficient thickness and strength to support the load which it is intended to lift. Two parallel slots 18 and 19 are cut into base plate 12, and saddle fitting 14 is inserted into base plate 12 by passing legs 20 through slots 18 and 19.

Saddle fitting 14 can be attached to base plate 12 by any means, but the simplest and most advantageous is to size legs 20 so that at their portion which is nearest base plate 12 they form a force fit into slots 18 and 19. Since usually there is no force applied to separate saddle fitting 14 from base plate 12, the force fit is quite stable.

As can be seen in FIG. 1, saddle fitting 14 is formed generally in the shape of a channel with legs 20 approximately perpendicular to web 22 which joins legs 20 together. Once inserted into base plate 12, web 22 is generally in contact with and parallel to the portion of base plate 12 which is between slots 18 and 19. Saddle fitting 14 also includes extensions 24 which extend from web 22 beyond the length of legs 20.

Extensions 24 serve to increase the strength of core lifting fixture 10 by distributing the load from the portion of base plate 12 between slots 18 and 19 to the region of base plate 12 beyond the ends of slots 18 and 19. This particularly relieves the stress at the corners of slots 18 and 19.

When core lifting fixture 10 is in use, webbing 26 of a web lifting strap is passed through both of slots 18 and 19 and wrapped around the underside of saddle fitting 14. In FIG. 1 only one leg of webbing 26 is shown in order to permit better viewing of saddle fitting 14, but the second leg of the web lifting strap would pass through slot 18 as it does slot 19 and be parallel to webbing 26. The dimensions of slots 18 and 19 can easily be sized to accommodate any size web lifting sling.

Figure 2:
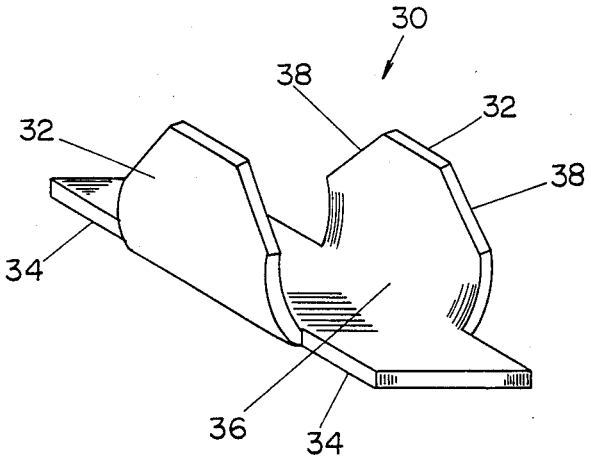
FIG. 2 is a perspective view of an alternate embodiment of the saddle fitting of the invention.

FIG. 2 shows a perspective view of an alternate embodiment of the saddle fitting of the invention. In FIG. 2 saddle fitting 30 is constructed, as was saddle fitting 14, with legs 32 and extensions 34. Extensions 34 are continuous with web 36 which connects legs 32. Saddle fitting 30 differs from saddle fitting 14 only in that it does not have full straight sides on legs 32, but has angles 38 over a portion of the legs. The important shape and size to either saddle fitting exists where it contacts base plate 12. At that point, if no other attachment means is used, there should be a force fit between the saddle fitting and the base plate, either in the dimension along the length of slots 18 or in the dimension of the web separating the slots so that the saddle fitting will not separate from the base plate.

Figure 3:
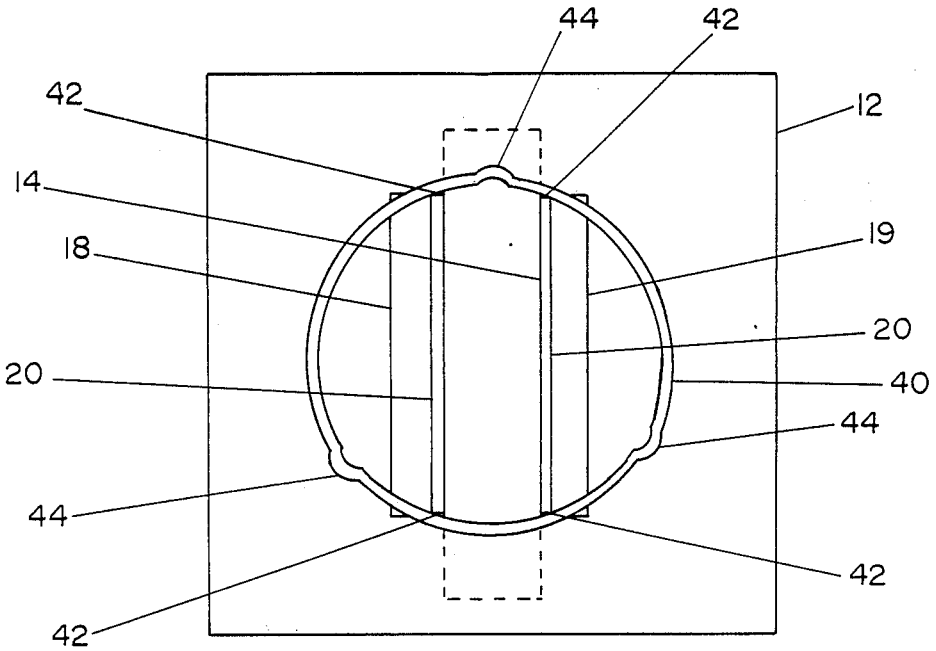
FIG. 3 is a top plan view of the alternate embodiment of the invention including a protective core cylinder.

FIG. 3 is a top plan view of the alternate embodiment of the invention which includes protective core cylinder 40. As can be appreciated from a comparison to FIG. 1, base plate 12 has saddle fitting 14 inserted through its slots 18 and 19 and so that legs 20 protrude upward (in the direction out of the paper).

Protective cylinder 40 is then placed atop base plate 12 by force fitting the inside diameter of protective cylinder 40 against the end edges of legs 20 at locations 42. Protective cylinder 40 thereby protects the inner surface of the load core which the core lifting fixture will hold from damage from contact with the edges of legs 20.

Protruding dimples 44 can also be formed in the outside surface of protective cylinder 40 if it is desirable to have protective cylinder 40 contact and hold the core of the lifted load.

It is to be understood that the form of this invention as shown is merely a preferred embodiment. Various changes may be made in the function and arrangement of parts; equivalent means may be substituted for those illustrated and described; and certain features may be used independently from others without departing from the spirit and scope of the invention as defined in the following claims. For instance, although the preferred embodiment uses force or friction fits to connect the various parts for the advantage of simplicity, other means of attaching the parts could be used.

What is claimed as new and for which Letters Patent of the United States are desired to be secured is:

1. A core lifting fixture for use with a web lifting sling for handling items which have a hollow core, comprising:

a base plate of essentially planar configuration dimensioned to support a hollow core load, including two parallel slots formed in the base plate with a spacing between them and penetrating the entire thickness of the base plate; and a saddle fixture in the shape of a channel with a planar web joining two approximately parallel planar legs which extend perpendicularly from the web, the legs having heights which exceed the thickness of the base plate and having lengths essentially equal to the length of the slots in the base plate, with the width of the web between the legs being essentially equal to the spacing between the slots in the base plate and the length of the web in the direction parallel to the length of the slots being greater than the length of the slots, the saddle fixture being inserted into the base plate by inserting its legs through the slots of the base plate with the surface of the web, including the surface of the length of the web which extends beyond the length of the slots, contacting the base plate.

2. The core lifting fixture of claim 1 wherein the saddle fixture is attached to the base plate by a force fit of the legs into the slots of the base plate.

3. The core lifting fixture of claim 1 further including a protective cylinder attached to the core lifting fixture and enclosing the legs of the saddle fixtures as they protrude through the base plate.

4. The core lifting fixture of claim 3 wherein the inside diameter of the protective cylinder has a force fit with the edges of the legs of the saddle fixture.

5. The core lifting fixture of claim 3 wherein the outside diameter of the protective cylinder has protrusions in order to contact the inside diameter of a core of a load to be lifted.

* * * * *